US005116447A

United States Patent [19]

Kimura et al.

[11] Patent Number: 5,116,447

[45] Date of Patent: May 26, 1992

[54] HIGH SPEED PICKLING DEVICE AND HIGH SPEED PICKLING METHOD

[75] Inventors: Tomoaki Kimura; Yoshio Takakura, both of Hitachi, Japan

[73] Assignee: Hitachi, Ltd., Japan

[21] Appl. No.: 670,763

[22] Filed: Mar. 15, 1991

[30] Foreign Application Priority Data

Mar. 16, 1990 [JP] Japan ..... 2-66309

[51] Int. Cl.[5] ..... B44C 1/22; C23F 1/00

[52] U.S. Cl. ..... 156/345; 134/41; 134/64 R; 134/122 R; 156/664

[58] Field of Search ..... 156/345, 664; 134/3, 134/32, 39, 41, 64 R, 84, 88, 122 R

[56] References Cited

U.S. PATENT DOCUMENTS 2,530,436 11/1950 Maleyre ..... 156/638 X
2,927,871 3/1960 Mancke et al. ..... 156/345 X
3,066,084 11/1962 Osterman et al. ..... 156/345 X

*Primary Examiner*—William A. Powell
*Attorney, Agent, or Firm*—Evenson, Wands, Edwards, Lenahan & McKeown

[57] ABSTRACT

A high speed pickling device for causing a thin plate to travel in acid fluid and removing through pickling oxidized scales which are formed on the surfaces of the thin plate, a plurality of weir members which dam wakes of the acid fluid flowing along the surfaces of the thin plate over substantially the entire width of the thin plate are provided in the traveling direction of the thin plate with a predetermined interval and close to the thin plate.

The weir members are provided close to the surfaces of the thin plate for damming and stripping off wakes of the acid fluid flowing along the surface of the thin plate at the inlet sides of these weir members, the acid fluid is caused to deflect in the opposite direction away from the thin plate, and fresh acid fluid is sucked onto its surface at the outlet sides of the weir members along with the traveling of the thin plate.

According to the present invention indicated above, by providing the weir members close to the thin plate, wakes of the acid fluid which flows along the thin plate is dammed and the most part thereof is stripped off from the thin plate. This stripped acid fluid flows in an opposite direction away from the thin plate and is drained along the weir members. The remaining wakes which were not stripped off by the weir members pass through a narrow clearance between the thin plate and the weir members and proceeds to the outlet sides of the weir members in the form of thin layered wakes. At the outlet sides of the weir members thickness of the wakes along the thin plate again tends to increase and fresh acid fluid is sucked to increase the wake thickness. By these draining and sucking of the acid fluid, replacement of the acid fluid is surely performed and pickling effect is enhanced and the pickling time is shortened.

23 Claims, 6 Drawing Sheets 1
3
4
5
5A
5B
6
7
8
9
14
15
16
19
25
26
27
28
30
31
32
34
40
41
42
43
44
V
V 1
5
8
9
14
16
16a
16a
42
43
44
45
VI
VI

HIGH SPEED PICKLING DEVICE AND HIGH SPEED PICKLING METHOD

BACKGROUND OF THE INVENTION

The present invention relates to a high speed pickling device and a method therefor, and in particular, relates to a high speed pickling device and a method therefor which removes in a short time oxidized scales formed on the surfaces of a thin plate during thin plate hot rolling.

Conventionally, removal of the oxidized scales on the surfaces of the thin plate after hot rolling was performed in such a manner that the thin plate was allowed to cool in the air to an ordinary temperature and was caused to travel in acid fluid such as hydrochloric acid and sulfuric acid having a concentration of 10–15% and at a temperature of 80° C. to thereby remove the oxidized scales through pickling as disclosed in JP-A-61-41783 (1986). Pads were provided so as to sandwich a thin plate at the top and bottom thereof, and by causing the thin plate to pass through a narrow passageway formed of the opposing wall surfaces of these pads, thin acid fluid layers of turbulent flow were formed by partially cutting boundary layers formed on the surfaces of the traveling thin plate thereby pickling the surfaces of the thin plate with these acid fluid layers. Further, in the pickling device the narrow passageway was partially enlarged at selected portions, a plurality of holes were provided at the pads and the narrow passageway and enlarged spaces were respectively communicated to the outside through these holes, through which the acid flows.

The replacement principle of the acid fluid in this conventional art utilizes change of dynamic pressure and static pressure which is caused by passing the wakes generated by the travel of the thin plate through the narrow passageways and wide spaces in alternation.

However, there was a problem that when the wide spaces were simply provided in the passageway, the conversion efficiency from dynamic pressure to static pressure was low and it was difficult to drain the wakes flowing along the thin plate with a full utilization of the dynamic pressure of the wakes.

Further, in JP-A-57-41384 (1982) reciprocatingly movable frames are provided so as to sandwich a thin plate at the top and bottom thereof, and on the planes of the movable frames facing to the thin plate a large number of stirring protrusions are provided. When the frames are moved reciprocatingly, the acid fluid covering the surfaces of the thin plate is stirred and disturbed by the protrusions which reciprocate together with the movable frames, thereby, the layer of the acid fluid traveling with the thin plate is broken, and the acid fluid is replaced.

However, in the device disclosed in JP-A-57-41384 (1982), there is a problem that although the acid fluid layers moving with the thin plate are stirred by the reciprocation of the stirring protrusions, no positive replacement of the acid fluid in the passageway between the top and bottom movable frames with acid fluid outside the passageway is performed, so that replacement by fresh acid fluid outside the passageway through stirring cannot be expected.

SUMMARY OF THE INVENTION

An object of the present invention is to provide a high speed pickling device and a method therefor which effectively replace the acid fluid in the wakes flowing along a thin plate and further shorten the pickling time.

For achieving the above object, in a high speed pickling device for causing a thin plate to travel in acid fluid and removing through pickling oxidized scales which are formed on the thin plate according to the present invention, a plurality of weir members are provided which dam wakes of the acid fluid flowing along the surfaces of the thin plate over substantially the entire width of the thin plate and are disposed close to the thin plate in the proceeding direction of the thin plate with a predetermined interval Further, for achieving the above object, in a high speed pickling method for causing a thin plate to travel in acid fluid and removing through pickling oxidized scales which are formed on the surfaces of the thin plate according to the present invention, weir members are provided close to the surfaces of the thin plate, wakes of the above acid fluid flowing along the surfaces of the thin plate are dammed and stripped off at the inlet sides of these weir members, the acid fluid is deflected in the opposite direction away from the thin plate, and fresh acid fluid is sucked onto the surface at the outlet sides of the weir members along with traveling of the thin plate.

According to the present invention as explained above, the replacement of the acid liquid is effectively carried out through the discharge and suction of the acid liquid at the inlet side and outlet side of these weir members and the advantage of shortening the pickling time is achieved.

DETAILED DESCRIPTION OF THE PREFERRED EMBODIMENTS

A first embodiment of a high speed pickling device according to the present invention is explained with reference to FIG. 1 through FIG. 7.

Figure 1:
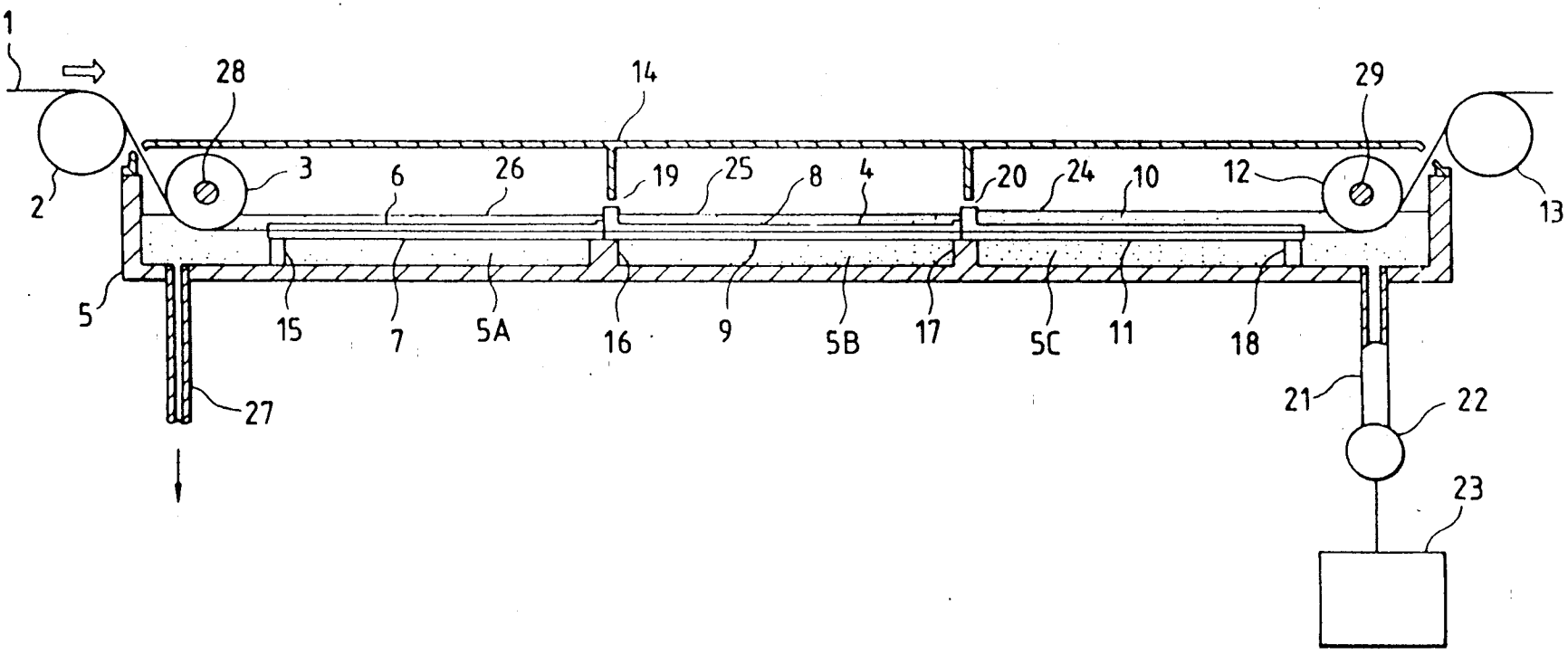
FIG. 1 is a sectional view showing an entire constitution of a high speed pickling device according to one embodiment of the present invention.

In FIG. 1, a thin plate 1 to be treated by acid fluid is led from a roller 2 via a deflector roller 3 to an acid fluid tank 5 wherein acid fluid 4 is contained. The acid fluid tank 5 is partitioned into a first pickling bath 5A, a second pickling bath 5B and a third pickling bath 5C in the acid fluid 4 of the respective pickling baths A, 5B and 5C, top part and a bottom part passageway guides 6 and 7, top part and a bottom part passageway guides 8 and 9, and top part and a bottom part passageway guides 10 and 11 are respectively provided. These top part and bottom part passageway guides (hereinbelow simply referred to as top and bottom passageway guides) provide rectangular narrow tunnel-shaped passageways (refer to FIG. 5) and the thin plate 1 is pickled while traveling along these passageways.

The length of the respective pickling baths 5A, 5B and 5C is usually about 15-30 m, and is determined according by pickling speeds or the type of steel of the thin plate 1. Plate thickness of the thin plate 1 to be handled is 1.2-4.5 mm, plate width thereof 70-1600 mm, and treatment speed is typically about 300 mpm and about 600 mpm maximum.

The pickled thin plate 1 is deflected by a deflector roller 12, drawn out from the acid fluid tank 5, returned to horizontal by a roller 13, and shifted to a next step such as rinsing not shown in the drawing. The acid fluid tank 5 is provided with a cover 14 to prevent outflow of fumes of the acid fluid.

Both ends of the top and bottom passageway guides 6 and 7 are supported by struts 15 and 16, those of the top and bottom passageway guides 8 and 9 by struts 16 and 17, those of the top and bottom passageway guides 10 and 11 by struts 17 and 18, respectively. The struts 15 and 18 at the both ends are formed with a large number of openings such as slits and structured so as to allow passage of acid fluid, while the other struts 16 and 17 are provided with no holes and are structured so as not to allow passage of the acid fluid. Further, on the end parts of at least one set of the top and bottom passageway guides 8 and 9 out of the end parts of two sets of the top and bottom passageway guides which are supported by the strut 16 is formed a weir structure 19. Similarly on the end parts of at least one set of the top and bottom passageway guides 10 and 11 out of the end parts of two sets of the top and bottom passageway guides which are supported by the strut 17 is formed a weir structure 20. These weir structures 19 and 20, and the struts 16 and 17 constitute a partition means for partitioning the acid fluid tank 5 into the first pickling bath 5A, the second pickling bath 5B and the third pickling bath 5C. Namely, the first pickling bath 5A and the second pickling bath 5B are partitioned by the strut 16 and the weir structure 19, and the second pickling bath 5B and the third pickling bath 5C are partitioned by the strut 17 and the weir structure 20.

The acid fluid tank 5 is connected at the third pickling bath 5C through a pipe 21 with a pump 22 and a fresh acid fluid tank 23, and fresh acid fluid is supplied from the tank 23 by the pump 22 through the pipe 21. The acid fluid which is supplied to the third pickling bath 5C successively inflows into the second pickling bath 5B and the first pickling bath 5A through the top and bottom passageway guides as described below. In this instance, due to flow passage resistance through the respective passageway guides, level 24 in the third pickling bath 5C becomes higher than level 25 in the second pickling bath 5B and the level 25 in the second pickling bath 5B becomes higher than level 26 in the first pickling bath 5A. Consequently, the height of the weir structure 20 is chosen to be higher than that of the weir structure 19.

Through the above operation, the acid fluid is used for pickling the thin plate 1 in the course of passing through the respective pickling baths, and the acid fluid in the first pickling bath 5A shows the lowest acid fluid concentration and a high iron oxide content. This used acid fluid is gradually drained to the outside through a pipe 27 which is connected to the first pickling bath 5A and is recovered in an acid fluid treatment device not shown in the drawing.

Further, a drive axis 28 for the defector roller 3 which causes the thin plate 1 to immerse into the acid fluid 4 and a drive axis 29 for the deflector roller 12 which draws out thin plate 1 from the acid fluid 4 are arranged above the levels 26 and 24, and thereby action of the acid fluid on bearings not shown which support the drive axes 28 and 29 is eliminated and life time thereof is extended.

Figure 2:
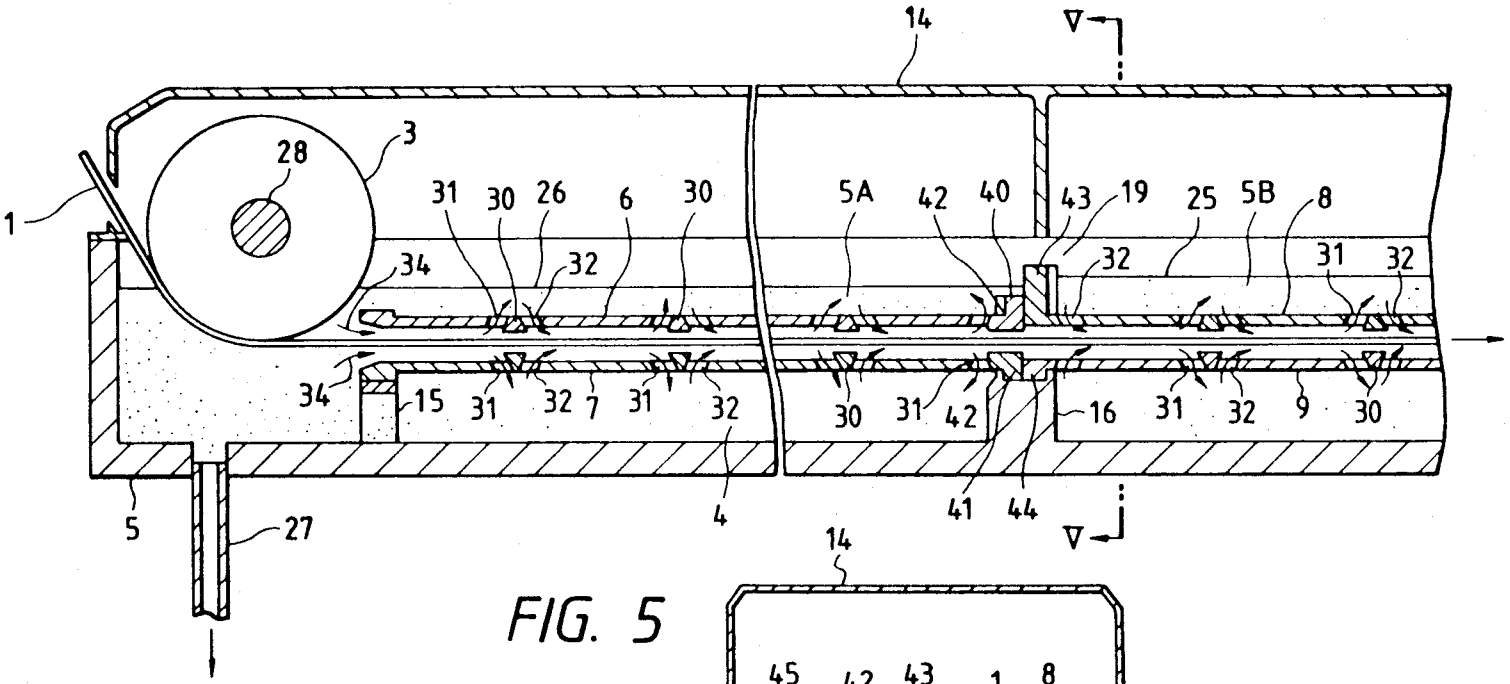
FIG. 2 is a partial sectional view of the high speed pickling device shown in FIG. 1.
Figure 3:
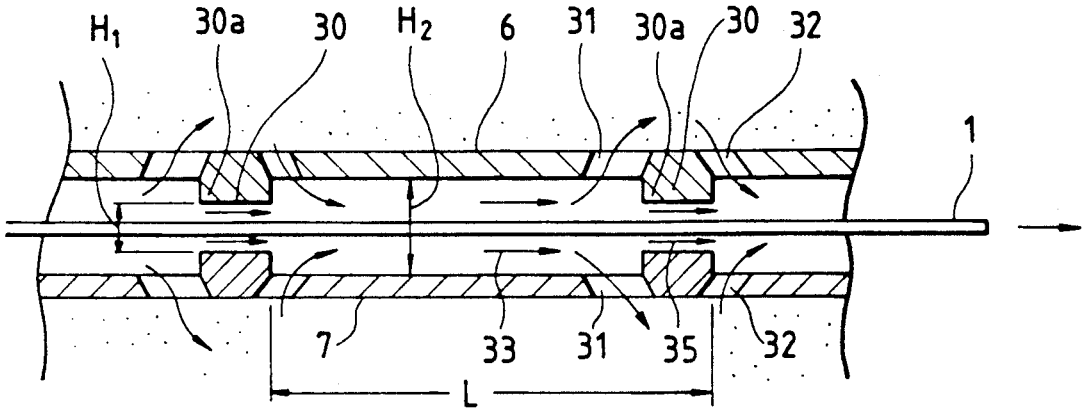
FIG. 3 is an enlarged sectional view of a main part showing action of weir members in the high speed pickling device of the present embodiment shown in FIG. 1.

FIG. 2 shows a detailed structure of the top and bottom passageway guides. In FIG. 2 the first pickling bath 5A and the second pickling bath 5B are provided with the top and bottom passageway guides 6 and 7, and the top and bottom passageway guides 8 and 9, respectively as explained above. These passageway guides are provided with a plurality of weir members 30 which are disposed close to the thin plate 1 and perpendicular to the traveling direction of the thin plate 1 with a predetermined interval. At the inlet sides of the weir members 30 drain holes 31 are formed and at the outlet sides feed holes 32 are formed. The weir members 30 are preferably made of hard acid resistant materials such as natural stone and ceramics to prevent the thin plate 1 from being scratched when the thin plate 1 touches thereto. Further, the weir members 30, as shown in an enlarged view in FIG. 3, are rectangular in sectional form at the side facing to the thin plate 1 and are formed close to the thin plate 1 with an angle part 30*a* of almost 90° at the inlet sides of the weir members 30.

When the thin plate 1 travels in the right direction in the drawing, wakes 33 of the acid fluid are formed on the surfaces of the thin plate 1 along with the traveling thereof, and by the formation of these wakes 33 the acid fluid is sucked into between the top and bottom passageway guides 6 and 7 as shown by arrows 34 in FIG. 2. The wakes 33 which are formed on the thin plate 1 are dammed by the weir members 30 and for the most part thereof are stripped off from the thin plate 1, flow along the surfaces of the weir members 30 in opposite direction away from the thin plate 1, and are drained from the drain holes 30. This stripping off of the wakes 33 is performed effectively because the weir members 30 are formed into a shape with the angle part 30*a*. The remaining wakes which were not stripped off by the weir members 30 pass the narrow clearances between the thin plate 1 and the weir members 30 and travel to the outlet sides of the weir members 30 while forming thin layer wakes 35. Since at the outlet sides of the weir members 30 the amount of the clearance in the passageway is restored, thickness of the wakes flowing along the thin plate 1 tends to increase and fresh acid fluid is sucked from the feed holes 32 due to this increase of the wake thickness.

In this way, the replacement of the acid fluid is surely performed and the pickling effect is enhanced by stripping off the most of the wakes 33 at the inlet sides of the weir members 30 and draining thereof and by sucking fresh acid fluid at the outlet sides. Further, during the replacement of the acid fluid turbulence occurs at the inlet sides of the weir members 30 by damming the wakes 33 and at the outlets thereof by inflowing the fresh acid fluid respectively, and the pickling effect is also enhanced by this turbulence. Especially, at the outlets of the weir members 30 by this turbulence the replacement of the acid fluid extends to near the surfaces of the thin plate, and the pickling effect is remarkably improved.

Usually, for attaining the above pickling effect a pitch of the weir members L is selected to be about 300-2000 mm. Naturally the smaller this pitch is, the higher the pickling effect is. Further, if the pitch is shortened such as L=50-300 mm, the structure becomes somewhat complicated, however this may not be impossible.

The clearance H2 of the passageways between the top and bottom passageway guides is selected to be about 30-150 mm although somewhat variable depending on the plate thickness of the thin plate 1. The narrowest passage clearance H1 at between the weir members 30 is selected to be about one third of H2, i.e. 10-50 mm.

Assuming that treatment speed is 5 m/sec. total dynamic pressure which is caused by this arrangement is 1.25 m water column, and two thirds thereof is dammed by the weir members 30, thereby a drain pressure of about 0.8 m water column is obtained at the inlet sides of the weir members and an effective drainage of the wake 33 is performed.

Figure 4:
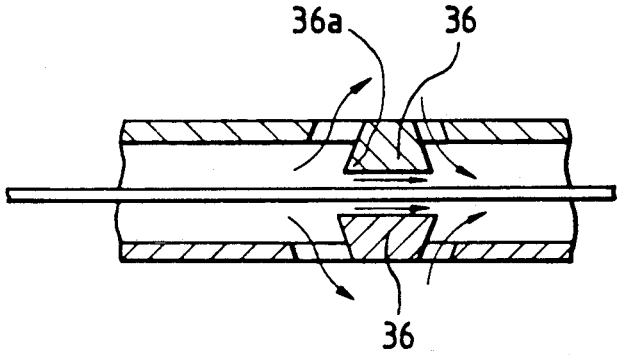
FIG. 4 is an enlarged sectional view of a main part in a high speed pickling device according to another embodiment of the present invention showing a weir member having a modified sectional configuration.

Further, shape of the weir members is not limited to that of the above embodiment but several kinds of modifications are possible. For example as shown in FIG. 4 a trapezoid-shaped weir member 36 may be used, and in this instance since an angle part 36*a* has an acute angle less than 90° the drainage and the suction of the wakes 33 onto the thin plate 1 can be performed further smoothly and effectively.

Returning now to FIG. 2, flanges 40 and 41 are provided at the end parts of the top and bottom passageway guides 6 and 7 where the guides are supported by the strut 16, the inner ends of these flanges 40 and 41 protruding toward the thin plate 1 to provide weir members 42 similar to the weir members 30, and drain holes 31 are similarly formed at the inlet sides of the weir members 42. Further, flanges 43 and 44 are provided at the end parts of the top and bottom passageway guides 8 and 9 where the guides are supported by the strut 16, the height of the flange 43 being set to be capable of maintaining the level 25 of the acid fluid in the second pickling bath 5B, and this portion provides the height of the weir structure 19 as explained above. Feed holes 32 are formed at the outlet sides of the flanges 43 and 44. The action of the weir members 42, the drain holes 31 and the feed holes 32 are substantially the same as that of the weir members 30, the drain holes 31 and the feed holes 32 as explained above.

Figure 5:
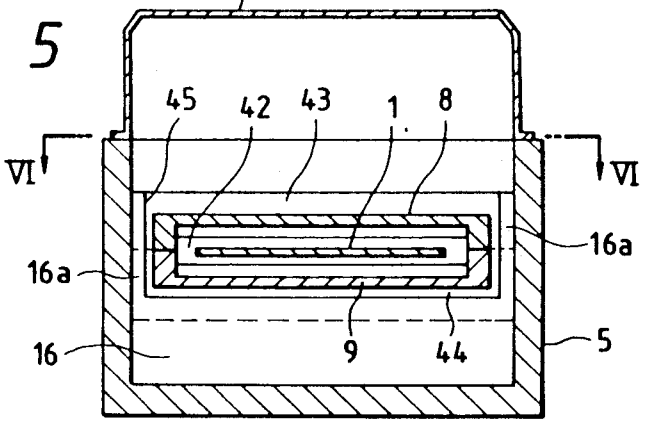
FIG. 5 is a sectional view taken along line V—V of FIG. 2.
Figure 6:
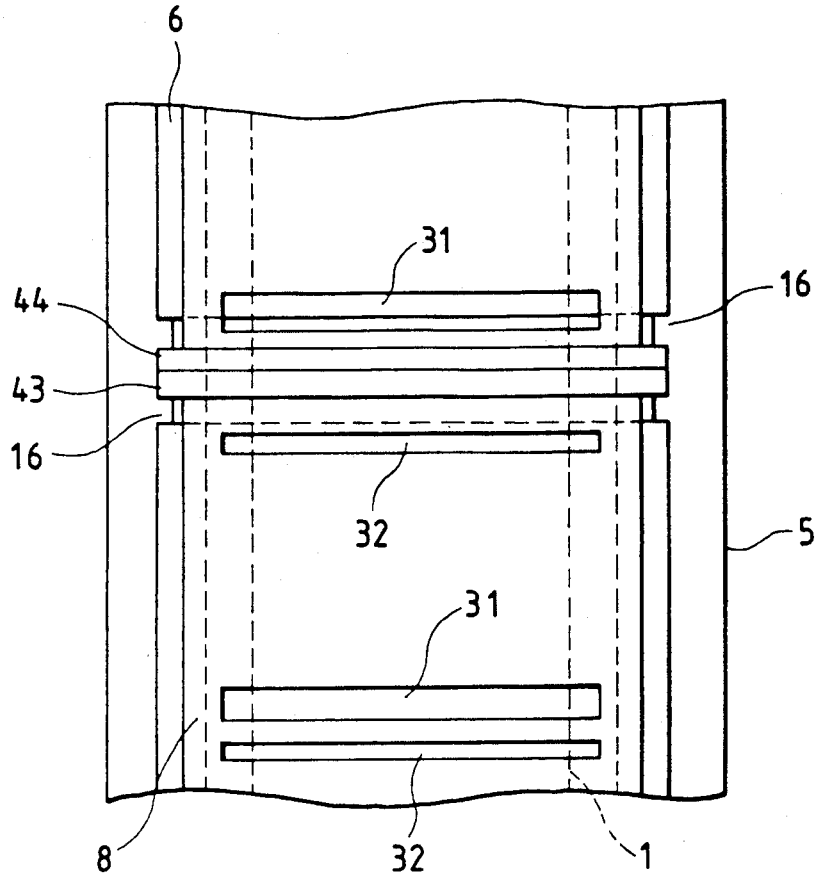
FIG. 6 is a view taken along line VI—VI and seen along the arrow of FIG. 5 when a cover is removed.

FIG. 5 and FIG. 6 show attaching states of the end part flanges 40, 41 and 43, 44 onto the strut 16. The strut 16 is provided with upright parts 16*a* along the side walls of the pickling tank 5 as shown in FIG. 5, and the end part flanges 40, 41 and 43, 44 are inserted into a spigot structure which is formed with the main body of the strut 16 the upright parts 16*a* thereof. Through such insertion of the end part flanges into the spigot structure, attachment and detachment of the top and bottom passageway flanges are performed easily to facilitate the maintenance.

Although not shown in the drawing, the same structure is employed at the top and bottom passageway guides 10 and 11 for the third pickling bath 5C, and at end parts of the second and the third pickling baths 5B and 5C and the strut 17 therefor.

Further, as can be understood from FIG. 5 and FIG. 6, within the top and bottom passageway guides the both sides of the thin plate 1 are spaced apart a little from the side walls of the passageway guides and clearances depending on the plate width of the thin plate 1 ar formed therebetween. In these clearances the wakes 33 along the thin plate 1 scarcely occur. Accordingly, the third pickling bath 5C communicates with the second pickling bath 5B, and the second pickling bath 5B with the first pickling bath 5A through the drain holes 31, the feed holes 32 and these clearances, and as explained above, also the acid fluid which is fed from the tank 23 to the third pickling bath 5C flows into the second pickling bath 5B and the first pickling bath 5A through these holes and clearances. In this instance, due to the above small clearances and the flow passage resistance, the levels 24, 25 and 26 which successively decrease are formed in the first through third pickling baths 5A-5C.

In the present embodiment constituted as above, by disposing the weir members 30 close to the thin plate 1 in the traveling direction of the thin plate 1 with a predetermined interval, the drainage of the wakes 33 and the replacement of the acid fluid through suction of the fresh acid fluid are effectively performed. Also, since during the replacement of this acid fluid the turbulence is caused at the inlet sides and the outlet sides of the weir members 30 the acid fluid is sufficiently mixed and the pickling effect is remarkably improved. Consequently, in comparison with the conventional pickling method the pickling time is shortened to about a half through one-thirds.

Further, since the pickling tank 5 partitioned into the first through the third pickling baths 5A-5C and the fresh acid fluid is caused to inflow successively from the third pickling bath 5C through the second pickling bath 5B to the first pickling bath 5A, the acid fluid becomes fresh in accordance with the progress of pickling degree of the thin plate and effective use of the acid fluid is enabled. Further, since in the third pickling bath 5C finishing is always performed by fresh acid fluid, clean finished surfaces are obtained and the pickling effect is improved.

Figure 7:
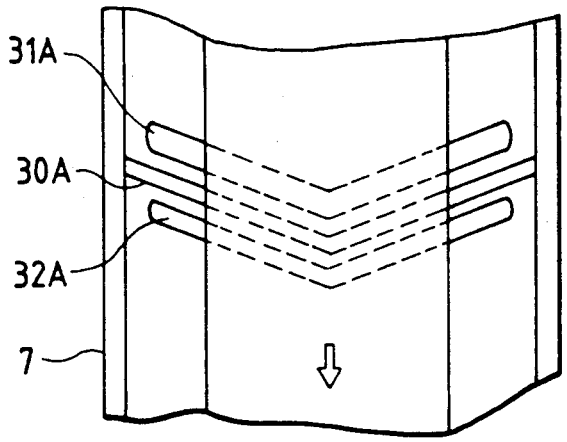
FIG. 7 is a partial plan view of a high speed pickling device showing a modified example of an entire shape of the weir members when a top passageway guide is removed.

In addition, although in the above embodiment the weir members 30 in FIG. 1 are arranged perpendicular to the traveling direction of the thin plate 1, angle-shaped weir members 30A wherein the longitudinal center portion thereof protrudes in the traveling direction of the thin plate 1 may be used as shown in FIG. 7 and in this instance drain holes 31A and feed holes 32A are likewise formed into an angle-shape. In this way, by forming the weir members into an angle-shape a rate of escaping to a lateral direction of the wakes dammed and stripped off by the weir members 30A decreases, and a rate of flow in opposite direction away from the thin plate 1 increases, the drainage of the wake is surely performed and the replacement of the acid fluid is further effectively performed.

A second embodiment of a high speed pickling device according to the present invention is explained with reference to FIG. 8 and FIG. 9.

Figure 8:
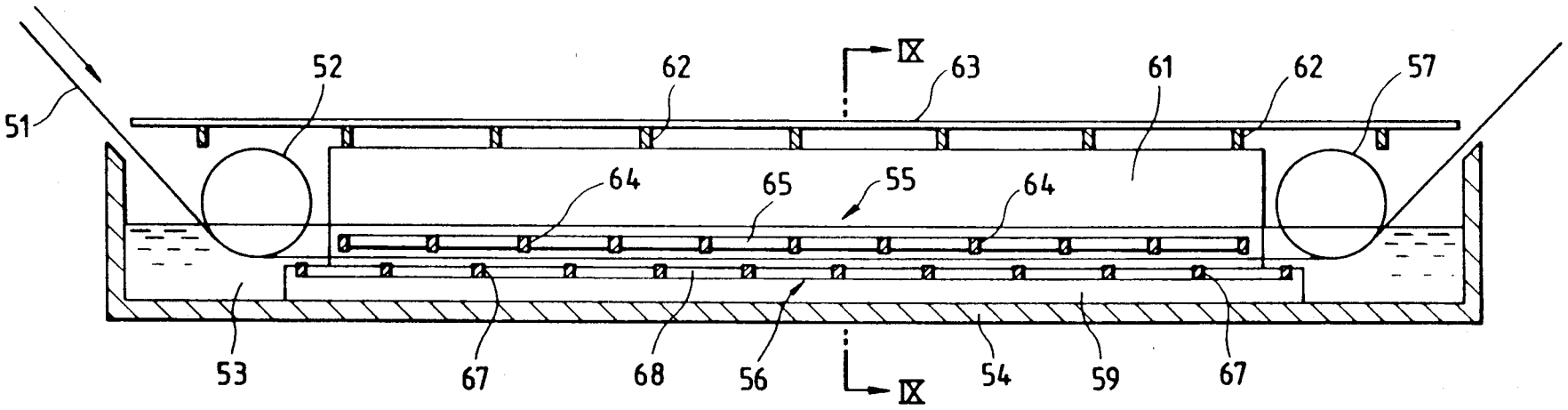
FIG. 8 is a sectional view showing an entire constitution of a high speed pickling device according to a further embodiment of the present invention.

In FIG. 8, a thin plate 51 is led by a deflector roller 52 to an acid fluid tank 54 in which acid fluid 53 is contained. The acid fluid tank 54 is provided with a top part and a bottom part weir assembly body 55 and 56, and the thin plate 51 is pickled while traveling through the passageway formed between these weir assembly bodies 55 and 56. The pickled thin plate 51 is bent by a deflector roller 57, is drawn up from the acid fluid tank 54, and is shifted to a next step such as rinsing which is not shown in the drawing.

Figure 9:
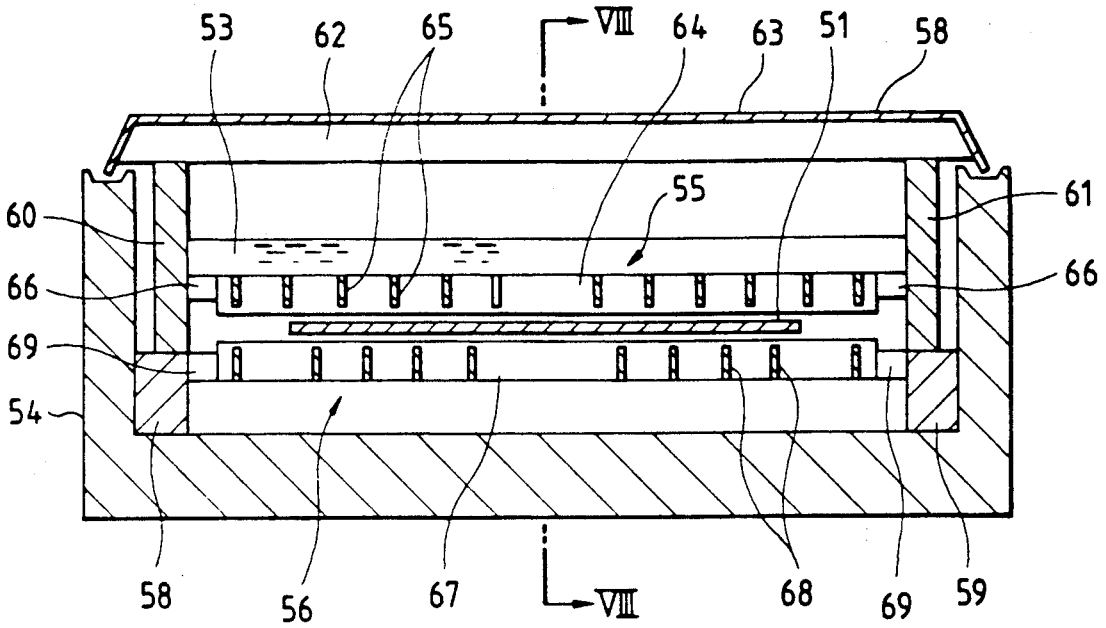
FIG. 9 is a sectional view taken along line IX—IX of FIG. 8, the line VIII—VIII in the drawing showing a section line for FIG. 8.

The support structure of the top and bottom weir assembly bodies 55 and 56 is shown in FIG. 9. The bottom weir assembly body 56 is attached to a pair of bottom plate frames 58 and 59 which are arranged on the bottom plane of the tank along the side walls of the pickling tank 54, and the top weir assembly body 55 is attached to a pair of top plate frames 60 and 61 which are disposed on the bottom plate frames 58 and 59. On the top end of the top part plate frames 60 and 61 a cover 63 which is reinforced with a plurality of ribs 62 is provided to prevent outflow of fumes of the acid fluid.

The top weir assembly body 58 comprises a plurality of weir members 64 which are arranged close to the thin plate 51 and crossing perpendicular to the traveling direction of the thin plate 1 with a predetermined interval and a plurality of grill members 65 which are arranged perpendicularly across these weir members 64 so as to provide a grill structure together with these weir members 64. The weir members are provided with fitting members 66 (refer to FIG. 1) at both ends thereof, and are connected to the top plate frames 60 and 61 through these fitting members 66. The bottom weir assembly body 59 preferably comprises weir members 67 and grill members 68, and the weir members 67 are connected to the bottom plate frames 58 and 59 through fitting members 69. Further, the weir members 64 of the top weir assembly body 58 and the weir members 67 of the bottom weir assembly body 59 are, as will be understood from FIG. 2, displaced in the traveling direction of the thin plate 51 and arranged in a staggered manner.

Figure 10:
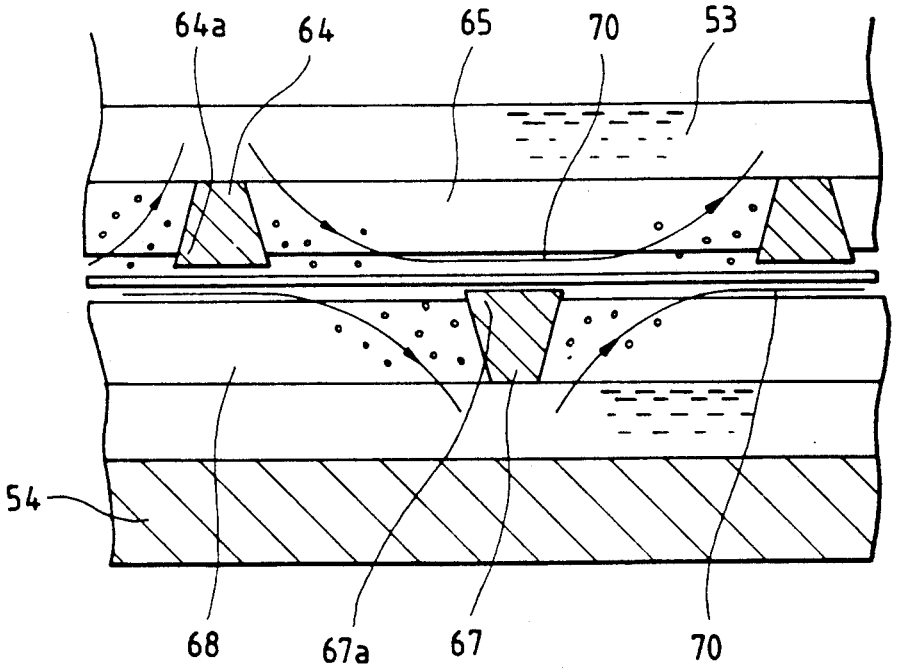
FIG. 10 is an enlarged view of a main part in the embodiment according to the present invention shown in FIG. 8 showing action of the weir members.

The weir members 64 and 67 are preferably made of hard acid resistant materials such as natural stone and ceramics to prevent the thin plate 51 from being scratched when the thin plate 51 touches thereto. Further, the weir members 64 and 67, as shown respectively in an enlargement in FIG. 10, have trapezoid-shaped sectional forms wherein the width at the thin plate side is larger, and angle parts 64*a* and 67*a* of an almost acute angle are formed close to the thin plate at the inlet sides of the weir members.

Basic action of the top and bottom weir members 64 and 67 of the weir assembly bodies thus constituted is substantially the same as that of the first embodiment. Namely, when the thin plate 51 travels to the right direction in the drawing, wakes 70 of the acid fluid are formed on the surfaces of the thin plate 51 along with the traveling thereof, and these wakes 70 are dammed by the weir members 64 and 67. Most of the dammed wakes by these weir members are stripped off from the thin plate 51 and flow in opposite direction away from the thin plate 51, and are drained to upward and downward of the weir members 64 and 67, respectively. This stripping off of the wakes 70 is surely performed because the weir members 64 and 67 are formed with the angle parts 64*a* and 67*a* of the acute angle. The rest of the wakes which were not stripped off by the weir members 64 and 67 pass through the narrow clearances between the thin plate 51 and the weir members 64 and 67, and travel to the outlet sides of the weir members 64 and 67 while forming thin layered wakes. At the outlet sides of the weir members 64 and 67, since the portions above and below the thin plate 51 are opened, thickness of the wakes 70 along with the thin plate 51 tends to increase, and fresh acid fluid is sucked due to the increase of the thickness of the wakes 70. Namely, the replacement of the acid fluid is performed. Further, at the outlet sides of the weir members turbulence occurs by the inflow of the fresh acid fluid and the pickling effect is enhanced.

And, in the present embodiment, since the portions between the top weir members 64 and those between the bottom weir members 67 are thoroughly opened respectively, as well the top and bottom weir members 64 and 67 being arranged in a staggered manner with respect to each other, and further the grill members 65 and 68 being provided so as to cross the weir members 64 and 67, the following function is further obtained.

Firstly, since the portions between the top weir members 64 and those between the bottom weir members 67 are thoroughly opened respectively, when the wakes which were stripped off at the inlet sides of the weir members 64 and 67 flow in opposite direction away from the thin plate 51, a part of the acid fluid is returned to the upstream sides of the weir members and turbulence occurs in the neighborhood thereof due to this returned acid fluid.

Further, since the top and bottom weir members 64 and 67 are arranged in a staggered manner, the weir members 64 and 67 can be positioned very close to the thin plate 51, and in certain circumstances the ends of the weir members 64 and 67 at the side of the thin plate can be arranged so as to project over a passline of the thin plate 51. Consequently, the wake becomes very thin during passing through the weir members and the replacement action of the acid fluid by the weir members 64 and 67 is further improved. Further, even if the end parts of the weir members 64 and 67 at the side of the thin plate 51 are arranged so as to project over the passline of the thin plate 51, no contact between the weir members and the thin plate 51 occurs because the wake inflows between the weir members 64, 67 and the thin plate 51 to bend the weir members 64, 67. Still further, ever if a slight contact may occur, scratching of the thin plate is prevented because the weir members 64, 67 are made of the hard material as explained above.

Further, since the grill members 65 and 68 are arranged across the weir members 64 and 67, and although a part of the wakes which have been stripped off by the weir members 64, 67 tends to flow in a lateral direction along the weir members 64, 67, this flow in the lateral direction is interrupted by the grill members 65 and 68 and the wakes surely flow in the opposite direction away from the thin plate 51. Consequently, the amount of the acid fluid which is returned to the upstream and causes the turbulence as explained above increases, and turbulence occurs further effectively in the upstream at the inlet sides of the weir members.

Further, in the present embodiment the top and bottom weir members 64 and 67 are arranged in a staggered manner as explained above, and when the weir members are arranged as such, bottom portions of the top weir members 64 and top portions of the bottom weir members 67 are respectively opened at the outside of the thin plate 51. If the grill members 65 and 68 are not provided, the wakes which flow in a lateral direction along the weir members bypass near from both ends of the thin plate 51 into the outlet sides of the weir members through the outside of the thin plate 51, and it is possible that the inflow of the fresh acid fluid would be obstructed. Since the bypass of the wakes near the both ends of thin plate 51 is prevented by the provision of the grill members 65 and 68 and the acid fluid is replaced uniformly along the width direction of the thin plate 51, the replacement action of the acid fluid is improved by the weir members.

Consequently, according to the present embodiment, by the provision of the open structure between the weir members and the grill members the generation of the turbulence is promoted and the acid fluid is further effectively mixed at this portion, and as well by the staggered arrangement of the weir members and by the provision of the grill members the replacement action of the acid fluid by the weir members is improved, and as a result, the pickling effect is extremely improved and the pickling time is further shortened.

Further, in the present embodiment, although the weir members in the open structure are arranged in a staggered manner, the weir members combined with the passageway guides as in the first embodiment may be arranged in a staggered manner, and in this instance the same effect as in the case of the above staggered arrangement is obtained.

According to the present invention as explained above, since the weir members are arranged close to the thin plate, by drainage and suction of the acid fluid at the inlet sides and the outlet sides of the weir members the acid fluid is surely replaced, the pickling effect is enhanced, further during this replacement of the acid fluid the turbulence is caused at the inlet sides and the outlet sides of the weir members, the pickling effect is also enhanced by this turbulence, and the pickling time is shortened by the improvement of the pickling effect.

Further according to the embodiments of the present invention, when the portions between the weir members are opened thoroughly, the generation of the turbulence at the inlet sides of the weir members is promoted and the pickling effect is further improved.

Similarly, when the weir members are arranged in a staggered manner, the replacement effect of the acid fluid by the weir members is improved and the pickling effect is further improved.

Likewise, when the grill members crossing the weir members are provided, the generation of the turbulence at the inlet sides of the weir members is further promoted, and since the acid fluid is replaced uniformly along the longitudinal direction of the thin plate, a further effective replacement of the acid fluid can be performed.

We claim:

1. In a high speed pickling device for causing a thin plate to travel in acid fluid and removing through pickling oxidized scales which are formed on the surfaces of the thin plate, the improvement comprising:

a plurality of weir members which dam wakes of said acid fluid flowing along the surfaces of the thin plate over substantially an entire width of the thin plate, said weir members being provided in the traveling direction of said thin plate with a predetermined interval and substantially close to said thin plate.

2. In a high speed pickling device according to claim 1, wherein the plurality of weir members are located close to said thin plate at a side where the wakes of the acid fluid are dammed and are provided with angle parts for stripping off said wakes.

3. In a high speed pickling device according to claim 2, wherein the angle of said angle part is not more than approximately 90°.

4. In a high speed pickling device according to claim 1, wherein the respective sectional shapes of said weir members at the side of said thin plate are rectangular.

5. In a high speed pickling device according to claim 1, wherein the respective sectional shapes of said weir members are trapezoid.

6. In a high speed pickling device according to claim 1, wherein the plurality of said weir members are provided close to the respective surfaces of said thin plate, and the weir members which face one surface of the thin plate are arranged in a staggered manner to the weir members which face to the other surface of the thin plate in the traveling direction of said thin plate.

7. In a high speed pickling device causing a thin plate to travel in acid fluid and removing through pickling oxidized scales which are formed on the surfaces of the thin plate, the improvement comprising:

a plurality of weir members which dam wakes of said acid fluid flowing along the surfaces of the thin plate over substantially an entire width of the thin plate, said weir members being provided in the traveling direction of said thin plate with a predetermined interval and close to said thin plate, and a plurality grill members which suppress a lateral flow of the acid fluid flowing along the weir members and which are provided across the plurality of said weir members.

8. In a high speed pickling device according to claim 7, wherein the plurality of weir members are shaped such that the respective central parts in their longitudinal directions project in the traveling direction of said thin plate.

9. In a high speed pickling device for causing a thin plate to travel in acid fluid and removing through pickling oxidized scales which are formed on the surfaces of the thin plate, the improvement comprising:

a plurality of weir members which dam wakes of said acid fluid flowing along the surfaces of the thin plate over substantially an entire width of the thin plate, said weir members being provided in the traveling direction of said thin plate with a predetermined interval and substantially close to said thin plate, and passageway walls for providing passageways for said thin plate, said passageway walls arranged between a plurality of said weir members and located further away from said thin plate than said weir members, and forming passageways with portions located at the inlet side and at the outlet side of the weir members and which are open, said portions having drain holes and feed holes for the acid fluid.

10. In a high speed pickling device according to claim 9, wherein the portions between said weir members are completely opened.

11. In a high speed pickling device for causing a thin plate to travel in acid fluid and removing through pickling oxidized scales which are formed on the surfaces of the thin plate, the improvement comprising:

a plurality of weir members which dam wakes of said acid fluid flowing along the surfaces of the thin plate over substantially an entire width of the thin plate, said weir members being provided in the traveling direction of said thin plate with a predetermined interval and substantially close to said thin plate, and a tank for accommodating said acid fluid, a plurality of partition means which divide said tank into a plurality of cells and each including an opening through which said thin plate passes, acid fluid supply means connected to a downstream side cell among the plurality of said cells in the traveling direction of said thin plate and acid fluid draining means connected to an upstream side cell, wherein a plurality of said weir members are disposed respectively in a plurality of said cells, and the height of the plurality of said partition means successively increases from upstream side to downstream side in the traveling direction of said thin plate.

12. In a high speed pickling device for causing a thin plate to travel in acid fluid and removing through pickling oxidized scales which are formed on the surfaces of the thin plate, the improvement comprising:

first means for damming wakes of said acid fluid flowing along the surfaces of the thin plate over substantially an entire width of the thin plate at a plurality of places in the traveling direction of said thin plate and stripping off the acid fluid from the surfaces of the thin plate, and allowing sucking of fresh acid fluid onto the surfaces at the downstream side immediately thereafter along with the traveling of said thin plate.

13. In a high speed pickling device according to claim 12, wherein said first means includes a plurality of weir members which are disposed across the traveling direction of said thin plate with a predetermined interval along the traveling direction.

14. In a high speed pickling device according to claim 12, the improvement further comprising:

a second means for suppressing a lateral flow of the acid fluid dammed by said first means.

15. In a high speed pickling device according to claim 14, wherein said second means includes a plurality of grill members forming a grill structure in cooperation with said first means.

16. A high speed pickling device for causing a thin plate to travel in acid fluid and removing through pickling oxidized scales which are formed on the surfaces of the thin plate, comprising:

a tank for accommodating said acid fluid, a plurality of partition means which divide said tank into a plurality of cells and are respectively provided with openings for passage of said thin plate, and having a height which increases toward the downstream along the traveling direction of said thin plate, means connected to one of said cells at the downstream side in the traveling direction of said thin plate among a plurality of said cells for supplying the acid fluid to the cell, means which is connected to one of said cells at the upstream side in the traveling direction of said thin plate among a plurality of said cells for draining the acid fluid from the cell.

17. A high speed pickling device according to claim 16, wherein at least one of the plurality of cells is provided with a plurality of weir members for damming wakes of said acid fluid flowing along the surfaces of the thin plate, said weir members being disposed close to the surfaces of the thin plate with a predetermined interval along the traveling direction of said thin plate.

18. In a high speed pickling device for causing a thin plate to travel in acid fluid and removing through pickling oxidized scales which are formed on the surfaces of the thin plate, the improvement comprising:

positioning weir members close to the surfaces of said thin plate for damming and stripping off wakes of said acid fluid flowing along the surface of said thin plate at inlet sides of said weir members, thereby causing said acid fluid to be deflected in the opposite direction away from the thin plate, and fresh acid fluid to be sucked onto the surface of said thin plate at outlet sides of said weir members along with the traveling of said thin plate.

19. In a high speed pickling method according to claim 18, the improvement further comprising:

causing in the wakes near the inlet sides of said weir members turbulence through the flow of the acid fluid which is dammed and stripped off by said weir members and is deflected in the opposite direction away from said thin plate.

20. In a high speed pickling method for causing a thin plate to travel in acid fluid and removing through pickling oxidized scales which are formed on the surfaces of the thin plate, the improvement comprising:

positioning weir members close to the surfaces of said thin plate, and members which cross to said weir members are provided, damming and stripping off wakes of said acid fluid flowing along the surface of said thin plate at the inlet sides of these weir members, deflecting said acid fluid in the opposite direction away from the thin plate, sucking fresh acid fluid is onto the surface of said thin plate at the outlet sides of said weir members along with the traveling os said thin plate, and suppressing a lateral flow of said acid fluid which is dammed at the front faces of said weir members.

21. A high speed pickling device for pickling a plate in acid fluid to remove oxidized scales from the surfaces of the plate, comprising:

a tank in which acid fluid is supplied and the plate is passed in a traveling direction, the passing of the plate through the acid fluid creating wakes along the surfaces of the plate;

a plurality of weir members that dam said wakes, said weir members being spaced in said tank at intervals along the traveling direction.

22. The high speed pickling device according to claim 21, wherein said weir members are arranged over substantially an entire width of the plate.

23. The high speed pickling device according to claim 22, further comprising a plurality of grill members in the tank which suppress a lateral flow of the acid fluid flowing along the weir members.

* * * * *